United States Patent [19]

Cline et al.

[11] Patent Number: 4,704,250

[45] Date of Patent: Nov. 3, 1987

[54] METHOD FOR MAKING BORON CARBIDE CERMETS

[75] Inventors: Carl F. Cline, Danville; Fred J. Fulton, Livermore, both of Calif.

[73] Assignee: The United States of America as represented by the United States Department of Energy, Washington, D.C.

[21] Appl. No.: 926,500

[22] Filed: Nov. 4, 1986

[51] Int. Cl.[4] ..... B22F 1/02; C22C 29/02

[52] U.S. Cl. ..... 419/15; 419/14; 419/35; 419/45; 419/51; 419/54; 419/64; 75/236; 427/217; 427/229; 428/539.5

[58] Field of Search ..... 75/236, 238, 246, 248, 75/249, 250; 419/14, 25, 35, 45, 51, 54, 55, 64, 15; 427/217, 229; 428/539.5; 264/125

[56] References Cited

U.S. PATENT DOCUMENTS

| | | | |
|---|---|---|---|
| 3,890,690 | 6/1975 | Li | 428/439.5 |
| 4,227,928 | 10/1980 | Wang | 419/35 |
| 4,605,440 | 8/1986 | Halverson et al. | 419/14 |
| 4,626,451 | 12/1986 | Tanaka et al. | 427/229 |

FOREIGN PATENT DOCUMENTS

| | | | |
|---|---|---|---|
| 1107833 | 5/1961 | Fed. Rep. of Germany | 419/45 |
| 55-69202 | 5/1980 | Japan | 419/45 |

*Primary Examiner*—John F. Terapane
*Assistant Examiner*—Eric Jorgensen
*Attorney, Agent, or Firm*—John F. Schipper; L. E. Carnahan; Judson R. Hightower

[57] ABSTRACT

A method for synthesizing low density cermets of boron carbide and a metal binder, using decomposition of a metallic compound at controlled temperature and pressure.

3 Claims, No Drawings

METHOD FOR MAKING BORON CARBIDE CERMETS

FIELD OF THE INVENTION

The U.S. Government has rights in this invention pursuant to Contract No. W-7405-ENG-48 between tne U.S. Department of Energy and the University of California, for the operation of Lawrence Livermore National Laboratory.

This invention relates to a process for forming low density cermets such as titanium bonded to boron carbide. These materials often possess high strength and may be used as abrasive tools, for armor materials and for similar purposes.

BACKGROUND OF THE INVENTION

Conventional methods for forming low density boron carbide cermet have not been notably successful. The ball-milling method, one of the oldest approaches, requires that: the concentrated refractory ore be refined to a pure oxide or other chemical compound; this compound be reduced to pure refractory metal and ground into a powder; the refractory metal be heated in the presence of carbon to form a metal carbide; the metal carbide be mixed with a powdered metal binder; the mixture be comminuted by ball milling to produce a slurry of blended cermet powder (of representative size 1–10 um diameter); and the slurry be dried and/or compacted to form a cermet powder. This process is expensive and labor-intensive, and it produces a cermet powder with density close to that of the metal binder, which is usually much heavier than the refractory metal or compound. For example, solid boron carbide has a maximum density of approximately 2.52 gm/cm$^3$, whereas solid titanium has a density of approximately 4.5 gm/cm$^3$. The higher density of the cermet is in part due to the small size particles of refractory material that are used in or result from such processes.

Borg, Lai, Riley and Wolfe, in U.S. Pat. No. 3,892,644, disclose a method of making very fine carbon cermet powders (typically, 0.01–0.1 um diameter), using a metal oxide and a metal carbide mixed with a polymerized furfuryl alchohol resin binder containing a catalyst, dried and formed as an anode for a high intensity electric arc circuit. The circuit is operated in a non-oxidizing atmosphere, and the anode is thereby consumed, producing a homogeneous cermet powder of finely divided metal carbide and metal binder particles.

An arc furnace process for producing boron carbide is disclosed by Scott in U.S. Pat. No. 3,161,471, using a reaction of boron oxide ore electrodes and coke or other pure carbon form positioned elsewhere in the furnace. This process produces small solid ingots of boron carbide. It is unclear whether a third (binder) element such as a metal could be added to the mixture.

SUMMARY OF THE INVENTION

It is an object of the invention to provide a method for synthesizing a low density cermet of boron carbide and a metal binder.

Another object is to provide a method for controlled reaction of titanium or other carbide-forming metal with the surfaces of particles or larger objects of boron carbide.

Other objects of the invention, and advantages thereof, will become clear by reference to the detailed description and the accompanying drawings.

To achieve the foregoing objects, in accordance with the invention, the method in one embodiment may comprise the steps of: providing a container of Ni or other suitable relatively inert metal; partly filling the container with a well-mixed combination of boron carbide particles of a predetermined size or sizes and metal hydride powder; heating the container and mixture to a temperature sufficient to decompose the metal hydride and maintaining that temperature for a period of substantially 24 hours; allowing the metal hydride to decompose to metal powder and H gas; drawing off the H gas; allowing a portion of the metal powder to react with the surfaces of the boron carbide particles to form metal-boron-carbide compounds on the surfaces of such particles; heating the metal-boron-carbide particles and the metal powder to a predetermined higher temperature and statically compressing the metal powder with the particles to promote flow of the remaining metal powder into interstitial regions between the particles; allowing the metal and metal-boron-carbide mixture to bond.

DETAILED DESCRIPTION

Preparation of boron carbide cermets such as titanium-boron-carbide, where possible, has formerly produced cermets whose densities are close to that of the heaviest constituent, which is usually the metal binder. The invention provides a method for preparation of low density boron carbide cermets whose density is close to that of the boron carbide, which is the lighter constituent.

One begins with boron carbide particles (of theoretical density $\rho=2.52$ gm/cm$^3$), which may be powder of diameter 100 um or greater or even chunks or macroscopic objects of the boron carbide. This is thoroughly mixed with a metal hydride binder component, which may be a hydride of any of the elements Si, Be, Al, Ti, V, Zr, Cr, Fe, Co, Ni, Cb, Mo, Hf, Ta or W, having respective solid densities of 2.3, 2.4, 2.7, 4.5, 5.6, 6.5, 7.2, 7.9, 8.9, 8.9, 8.6, 10.2, 13.3, 16.7 and 19.3 gm/cm$^3$. These elements are all strong-to-moderate carbide formers, with melting point temperatures much higher than the temperatures required (300°–600° C.) for chemical reactions witn hydrogen. The mixture is placed in a relatively inert metal container, which may be of Ni or another metal that is substantially non-reactive with boron carbide and with the metal in the mixture, and the container is placed in a vacuum of pressure $p \leqq 10^{-4}$ Torr and heated to decompose the metal hydride and drive off the hydrogen. For example, titanium hydride $TiH_2$ will decompose ($2TiH_2 \rightarrow 2TiH + H_2 \rightarrow 2Ti + 2H_2$) at temperatures of the order of 300°–600° C., yielding hydrogen gas and titanium metal (powder) that remains more or less in place. After the hydrogen gas has evolved and been drawn off by a vacuum pump or other similar device, the Ti undergoes limited reaction with the contiguous surfaces of the boron carbide particles to form a coating of Ti-B-C on the surfaces of the particles. After a sufficient thickness of Ti-B-C coating has formed on the surfaces (usually in 24 hours or less), the ambient temperature is raised to whatever temperature is required (e.g., $T_{room} \leqq T \leqq 700°$ C.) and the container is deformed inwardly by static pressures of up to 1–2 kbars, to promote flow of the remaining Ti metal into interstitial regions between the Ti-B-C particles and for further processing.

Formation of a thin Ti-B-C coating on the surfaces of the (former) boron carbide particles (1) keeps the average density of the coated particles near that of the lighter boron carbide ($\rho = 2.52$ gm/cm$^3$), and (2) provides a surface to which the remaining Ti metal can bond to form a binder or matrix for the boron carbide particles (or clumps). The amount of Ti metal remaining to form the binder should preferably be 5–25 percent by volume of the entire mix. Binder thickness (between nearest neighbor, coated boron carbide particles or clumps) of at least 200 Åis probably necessary to insure proper binding of the particles or clumps. If the binder thickness is kept approximately constant, increase of the representative diameter of the coated boron carbide particles or clumps will allow a decrease of the overall density of the cermet to a value near the density of the lighter boron carbide component.

After the coated boron carbide and remaining metal binder are raised to a higher temperature $T \leqq 700°$ C.); the container is sealed, and the container and its contents are statically compacted; at a pressure of tne order of $p = 1$–$2$ kbars, and held at that temperature and pressure for a period of 1–4 hours. This increases the density, or decreases the porosity, of the mixture and promotes flow of the metal binder into interstitial regions between adjacent coated boron carbide particles. This procedure produces an adequate boron carbide cermet specimen. The temperature and pressure are then lowered to room temperature and pressure, and the boron carbide cermet material is removed for use or fabrication into abrasive tools, defensive armor and the like.

This method benefits from the (1) initial intimate mixing of $TiH_x$ ($x = 1,2$) with the boron carbide, (2) low temperature decomposition of $TiH_x$, and (3) subsequent reaction of free Ti with the adjacent boron carbide (B-C). The adjacent B-C is cleansed and oxygen may be removed by the chemical evolution of hydrogen in the decomposition of $TiH_x$. This produces finely divided, clean, reactive Ti and allows consolidation to high density Ti-B-C coatings at relatively low temperatures; this method suppresses the tendency of the Ti to diffuse further into the B-C particles and produces a relatively thin, high purity Ti-B-C coating on the B-C particles.

In one series of runs, the pressure was initially increased to about 1 kbar at a temperature $T \approx 330°$ K., and the temperature was then increased to $T \approx 700°$ K., with a corresponding additional rise in pressure to 2 kbars, over a 20-minute interval; the temperature and pressure were maintained at such values for approximately 60 minutes, after which the gas pressure was bled off and the temperature was allowed to drop over a 25-minute interval.

The product produced by the process described above is unique and probably cannot be produced by any of the conventional processes known and used today. The invention produces a boron carbide cermet (ceramic plus metal binder) that is nearly as light as the boron carbide and which has nearly zero porosity and improved toughness.

The foregoing description of a preferred embodiment of the invention is presented for purposes of illustration only and is not intended to limit the invention to the precise form disclosed; modification and variation may be made without departing from what is regarded as the scope of the invention.

We claim:

1. A method for preparation of boron carbide cermet material, the method comprising the steps of:

providing boron carbide particles of representative diameter in the range 100 um or higher;

providing particles of a predetermined metal hydride of a representative diameter no more than 10 um;

mixing the boron carbide and metal hydride particles so that the metal hydride particles coat the surfaces of the boron carbide particles;

placing the mixture in a metal container that is relatively inert with respect to chemical reactions with the metal hydride or with the boron carbide;

providing an air-tight seal for the container;

heating the container and mixture to a temperature $T_1$ sufficient to decompose the metal hydride and release the hydrogen as a gas, and maintaining this temperature for a time period of at most 24 hours;

imposing a vacuum of pressure at most $10^{-4}$ Torr on the contents of the heated container and removing the hydrogen gas from the container;

increasing the temperature of the container contents to a predetermined temperature $T_2$, which lies substantially between room temperature and 700° C., and imposing a predetermined static pressure p of substantially one kilobar or greater on the exterior walls of the container and maintaining this temperature and pressure for a time period of at least three hours, where this temperature and pressure are sufficient to deform the container walls and to cause the metal contained in the container to flow into and substantially fill all interstitial regions between adjacent boron carbide particles, and maintaining this temperature and pressure for at least one hour;

lowering the temperature and pressure imposed on the container and its contents to room temperature and pressure, respectively; and removing the mixture of boron carbide and metal from the container.

2. A method according to claim 1, wherein said predetermined metal hydride is drawn from a class consisting of Si, Be, Al, Ti, V, Zr, Cr, Fe, Co, Ni, Cb, Mo, Hf, Ta and W.

3. A method according to claim 1, wherein said temperature $T_1$ satisfies $300° \text{ C.} \leqq T_1 \leqq 600°$ C.

* * * * *